US007038416B2

(12) United States Patent
Erko et al.

(10) Patent No.: US 7,038,416 B2
(45) Date of Patent: May 2, 2006

(54) CONTROL SYSTEM FOR A FLOOR MAINTENANCE APPLIANCE

(75) Inventors: Robert J. Erko, Apple Valley, MN (US); John Peter Haeg, Minneapolis, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 10/153,406

(22) Filed: May 21, 2002

(65) Prior Publication Data

US 2002/0175648 A1 Nov. 28, 2002

Related U.S. Application Data

(60) Provisional application No. 60/293,018, filed on May 21, 2001.

(51) Int. Cl.
*G05B 11/01* (2006.01)

(52) U.S. Cl. ..... 318/560; 318/135; 318/430; 318/805; 15/49.1; 15/98

(58) Field of Classification Search ..... 318/560, 318/139, 565, 805, 812, 768, 430, 257, 135; 15/319, 49.1, 320, 98, 385
See application file for complete search history.

(56) References Cited

U.S. PATENT DOCUMENTS 4,406,980 A * 9/1983 Waldhauser et al. ..... 318/257
4,633,541 A * 1/1987 Block ..... 15/49.1
4,675,935 A * 6/1987 Kasper et al. ..... 15/319
4,757,566 A 7/1988 Field et al. ..... 15/49

(Continued)

FOREIGN PATENT DOCUMENTS

EP 0910981 4/1999

OTHER PUBLICATIONS

PCT International Search Report, PCT/US02/16248, Oct. 7, 2002; 4 pages.

*Primary Examiner*—David Martin
*Assistant Examiner*—Renata McCloud
(74) *Attorney, Agent, or Firm*—Fulbright & Jaworski LLP

(57) ABSTRACT

A control system for controlling the work output delivered to a floor surface by a work tool associated with a floor maintenance machine, such as a burnisher, is provided. In one embodiment, a voltage regulator regulates the voltage provided to the motor assembly that drives the work tool. A current sensor monitors the motor current drawn by the motor assembly and provides a signal representative thereof to a controller. The controller also receives as an input a work selector signal representative of a desired level of work output. Based on the work selector signal and the sensed motor current, the controller provides a control signal to an actuator. In response to the control signal, the actuator raises or lowers the work tool relative to the floor as need to control the work output delivered to the floor. In another embodiment, the voltage regulator is omitted, and the controller is configured to generate the control signal based on the product of the motor current and the voltage provided to the motor assembly.

16 Claims, 1 Drawing Sheet

U.S. PATENT DOCUMENTS 4,992,718 A * 2/1991 Kumaki ..... 318/768
5,044,043 A * 9/1991 Basham et al. ..... 15/319
5,435,035 A * 7/1995 Fujimoto et al. ..... 15/49.1
5,615,437 A * 4/1997 Takahashi et al. ..... 15/98
5,914,849 A * 6/1999 Perreira ..... 361/187
5,943,724 A 8/1999 Erko et al. ..... 15/49.1
6,163,915 A 12/2000 Kaczmarz et al. ..... 15/49.1
6,493,896 B1 * 12/2002 Stuchlik et al. ..... 15/49.1
6,518,719 B1 * 2/2003 Suzuki et al. ..... 318/430
6,614,195 B1 * 9/2003 Bushey et al. ..... 318/135

* cited by examiner

CONTROL SYSTEM FOR A FLOOR MAINTENANCE APPLIANCE

RELATED APPLICATION

This application claims the benefit of priority of U.S. Provisional Patent Application No. 60/293,018, filed on May 21, 2001, the disclosure of said application being incorporated by reference herein.

FIELD OF THE INVENTION

The present invention relates generally to floor maintenance or conditioning machines, and particularly those machines employing one or more floor maintenance or conditioning machines or tools that perform one or more tasks including, among others, scrubbing, sweeping, and polishing or burnishing.

BACKGROUND OF THE INVENTION

Surface maintenance machines that perform a single surface maintenance or surface conditioning task are well known. Surface maintenance machines are generally directed to applications such as floor surfaces, or simply floors. The term floor, as used herein, refers to any support surface, such as, among others, floors, pavements, road surfaces, ship decks, and the like.

Many floor or surface maintenance machines are constructed having a sole surface conditioning machine or system so as to only sweep, others to scrub, while still others to polish or burnish. Other floor maintenance machines may be configured to perform multiple types of surface maintenance tasks. One example of a multi-task surface conditioning machine is disclosed in U.S. Pat. No. 3,204,280, entitled, "Floor Cleaning & Waxing Machine," issued to Campbell. Another example is disclosed in U.S. Pat. No. 4,492,002, entitled, "Floor Cleaning Machine," in name of inventors Waldhauser, et al. Disclosed therein is a forward sweeper assembly followed by a scrubber assembly that is followed by a squeegee assembly. Yet, another example of a multi-task floor conditioning machine is disclosed in a PCT application published at WO 00/74549, on Dec. 14, 2000, entitled, "Floor Cleaning Machine," in name of inventors Thomas, et al.

Surface maintenance machines which perform a burnishing task generally include a scheme for controlling the degree of burnishing applied to a floor surface depending upon the type of floor surface. Such machines commonly include a driver assembly which includes a working appliance or tool, such as a pad or brush, affixed to a driver that is rotatably driven by a driver motor. The driver assembly is selectively raised and lowered by an actuator to achieve a desired force or pressure against a floor surface.

Surface maintenance machines which perform a scrubbing task also commonly include a driver assembly having a rotatable scrubber, such as a brush, pad, or the like, affixed to a scrubber head rotatably driven by a driver motor. The scrubber head typically is selectively raised and lowered by an actuator coupled to the driver to achieve a desired scrubbing force or pressure of the brush against a floor surface. Like burnishing machines, scrubbing machines generally include a scheme for controlling the scrubbing force or pressure applied to the floor surface. Examples of surface maintenance machines having scrubbing systems are taught in U.S. Pat. Nos. 4,757,566; 5,481,776; 5,615,437; 5,943,724; and 6,163,915.

Sweeper systems also are analogous to burnishing and scrubbing systems in that they too may include a rotatable sweeper tool (e.g., a brush) driven by a driver motor. Like burnishing and scrubbing systems, the sweeper system brush may be lowered and raised relative to a floor to achieve a desired sweeping result.

Schemes for controlling the burnishing/scrubbing/sweeping force typically employ a current sensor to monitor the current drawn by the driver motor. In such schemes, the sensed motor current may be used to control torque load on the driver motor such that a desired burnishing/scrubbing/sweeping force may be achieved. However, such schemes may not provide accurate control of the work output applied to the floor, because the voltage applied to the driver motor may vary, thus causing corresponding variations in speed and work output of the rotatable work tool. In accordance with other control schemes, a "pressure" sensor is employed that provides a signal that is representative of the pressure of the work tool against the floor. This signal also may be used to control torque load on the motor to achieve a desired work force or output, although, again, variations in driver motor voltage are not taken into account.

The shortcomings of such known control schemes are particularly noticeable in floor conditioning machines that are powered by a rechargeable battery supply. Although a rechargeable battery supply offers some conveniences, the battery voltage applied to the various floor conditioning systems or appliances, and particularly to the driver motor, decays in relation to the energy discharged by the battery and the total time of discharge. Thus, the available mechanical conditioning/working power that may be delivered to the floor varies dependent upon the voltage and current that the battery supply can deliver to the driver motor. That is, mechanical working power (i.e., work output delivered to the floor) is proportional to the power delivered to the driver motor.

Thus, for example, if the driver motor current is held constant, the conditioning work delivered to the floor surface will vary as a function of voltage applied to the driver motor (e.g., the battery voltage). As a result, when the driver motor load current is held constant (as is the case with known control schemes), more working power is delivered to the working appliance (i.e., brush or pad) at the beginning of the battery life cycle, and less working power is available at the end of the battery life cycle as the battery voltage decays. Such variation in mechanical working power delivered to the floor, however, may not be desirable because it can affect the consistency of the work results, particularly when the floor conditioning task is burnishing, and, even more particularly, when the burnishing task is part of a multi-task floor conditioning machine. Accordingly, it would be desirable to provide a floor conditioning system in which the amount of mechanical working power applied to the floor can be controlled at a desired level.

SUMMARY OF THE INVENTION

In accordance with a first aspect of the invention, a control system for controlling work output delivered to a floor surface by a work tool associated with a floor maintenance machine includes a power source, a motor assembly coupled to the power source and the work tool, a voltage regulator coupled between the power source and the motor assembly, an actuator assembly coupled to the work tool, a current monitor circuit in communication with the motor assembly, and a controller circuit in communication with the current monitor circuit and the actuator assembly. The voltage regulator is configured to regulate the output voltage provided by the power source and to apply the regulated voltage to the motor assembly. The current monitor circuit monitors the motor current and provides an indication thereof to the controller circuit. Based on the monitor motor current, the controller circuit generates a control signal which causes the actuator assembly to adjust contact of the work tool with the floor surface, thereby controlling work output delivered to the floor.

In accordance with another aspect of the invention, a control system for controlling work output delivered to a floor surface by a work tool associated with a floor maintenance appliance includes a power source, a motor assembly coupled to the power source and the work tool, an actuator assembly coupled to the work tool, a current monitor circuit configured to monitor motor current, a voltage monitor circuit configured to monitor the voltage provided by the power source, and a controller circuit. The controller circuit is configured to generate a control signal based on the monitored motor current and the monitored voltage. In response to the control signal, the actuator adjusts contact of the work tool with the floor surface as appropriate to control the work output delivered to the floor.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
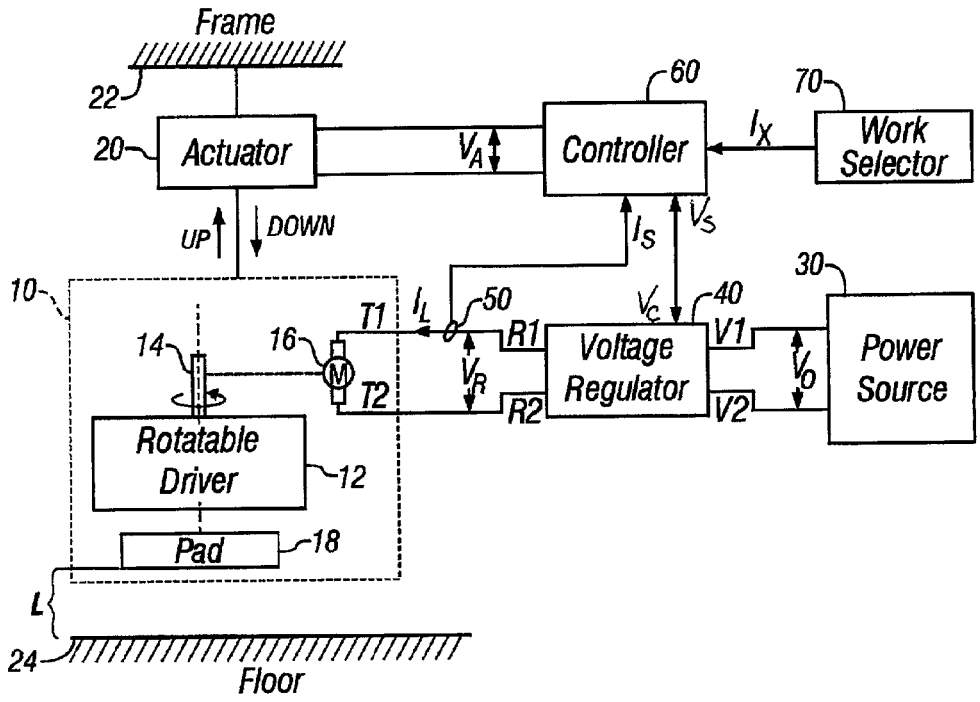
FIG. 1 is a schematic block diagram of an exemplary embodiment of a control system for a floor maintenance appliance for controlling the work output delivered to a floor surface.

Referring first to FIG. 1, a schematic block diagram is illustrated representing one exemplary embodiment of a control system for a floor maintenance appliance that controls the work output delivered to a floor by a rotatable work tool, such as a polishing pad, a scrubber, a brush, etc. In FIG. 1, a floor maintenance assembly 10 is configured as a burnishing system suspended from a frame 22 associated with a floor maintenance machine (not shown) by way of an actuator 20. The actuator 20 is configured to raise and lower the maintenance assembly 10 relative to the floor 24. Although a burnishing tool is illustrated in the Figures, it should be understood that the maintenance assembly 10 may be configured to perform other types of maintenance tasks, such as sweeping and scrubbing, or a combination of maintenance tasks.

As shown in FIG. 1, the maintenance assembly 10 includes a rotatable driver 12 having a rotatable shaft 14 coupled to a driver motor 16. The rotatable work tool for performing the work task is a burnishing pad 18 that is coupled to a rotatable driver 12. The maintenance assembly 10 and the actuator 20 may be implemented by way of a wide array of components and techniques, many of which have been described in the aforementioned published patents and publications, among others. One particular device finding applicability to the present invention is disclosed in U.S. patent application Ser. No. 10/153,408, entitled "Suspension Device for Floor Maintenance Appliance," filed May 21, 2002, claiming the benefit of priority of U.S. Provisional patent Ser. No. 60/292,683, having common assignee with the present invention, and being incorporated in its entirety by reference herein. More specifically, when the motor 16 causes the pad 18 to rotate and as the actuator 20 causes the assembly 10 to move downward, the pad 18 contacts the floor 24 such that a certain pressure is exerted. Further downward movement of the assembly 10 toward the floor 24 causes an increase in the amount of force or pressure of the pad 18 against the floor 24.

A power source 30, which provides the power to the assembly 10, applies an electric potential $V_O$ to the input of a voltage regulator 40. The power source 30 may be any type of suitable power source for the particular maintenance machine, such as a battery source, a rechargeable battery source, or other power supply that can provide an output voltage $V_O$ within an appropriate range. In the embodiment illustrated in FIG. 1, the power source 30 is a rechargeable battery source that provides a filly charged output voltage of approximately 36 volts.

The voltage regulator 40 converts the output voltage $V_O$ to a substantially constant electric potential $V_R$ which is provided at a pair of output terminals R1 and R2 coupled to motor terminals T1 and T2, respectively. The voltage regulator 40 may be configured as any of a variety of voltage regulators for providing a regulated voltage $V_R$ over a given range of voltage $V_O$. In an exemplary embodiment, the voltage regulator 40 is a pulse-width-modulated motor controller having the part number 1204 available from Curtis, which is configured to provide a regulated output $V_R$ of 32 volts from a voltage $V_O$ of about 36 volts.

In the embodiment illustrated in FIG. 1, the work output to the floor 24 is controlled by adjusting the distance of the assembly 10 relative to the floor 24 in response to a voltage $V_A$ applied to the actuator 20. Generation of the voltage $V_A$ is accomplished by utilizing a current sensor 50 configured to monitor the load current $I_L$ drawn by the driver motor 16 and to provide a signal $I_S$ representative of the load current $I_L$. Because the power provided to the motor 16 (i.e., the product of $V_R$ and $I_L$) is proportional to the work output delivered to the floor 24, and because the voltage $V_R$ applied to the motor 16 is regulated to a known value by the voltage regulator 40, variations in the load current $I_L$ are proportional to variations in the work output. Thus, the work output can be controlled based on the signal $I_S$. The current sensor 50 provides the signal $I_S$ as an input to a controller 60.

The current sensor 50 may be configured in a wide variety of arrangements, such as a current transformer, a low value resistor, etc., suitable to provide a signal $I_S$ that is representative of the load current $I_L$ and which is appropriately conditioned for input to the controller 60. The controller 60 is configured to control the position of the maintenance assembly 10 relative to the floor 24 to achieve a desired work output, i.e., the amount of work (e.g., scrubbing, burnishing, sweeping) accomplished by the appliance. A work selector 70, which may be coupled to a user interface (not shown), such as push buttons, multi-position switches, menu displays, etc., allows a user to manually select a desired work output setting (e.g., high, medium, low, etc.). Based on the selection, the work selector 70 provides the controller 60 with an input signal $I_X$ representative of the selected work output. By comparing the load current as represented by signal $I_S$ and the desired work output as represented by signal $I_X$, the controller 60 generates the actuator voltage $V_A$ which causes the actuator 20 to raise or lower the assembly 10 relative to the floor 24, thereby controlling the level of work output.

The combination of the voltage regulator 40, the current sensor 50, and the controller 60 in the control scheme illustrated in FIG. 1 can eliminate variations in work output that may be caused by variations in the voltage $V_S$ provided by the power source 30, as well as variations of other parameters that contribute to changes in the load current $I_L$ through the motor 16, such as the characteristics of the floor surface (e.g., bumps, dips, tacky, slippery, etc.). Thus, the illustrated control scheme can enable maintenance of the work output at a desired level.

However, in some floor maintenance applications, it may be desirable to vary the work output based on certain parameters as opposed to maintaining the work output at a constant level. For example, for a battery-operated floor maintenance machine, it may be desirable to control the rotational speed of the work tool over time (and thus the work output over time) based on the status of the battery over time. In another example, for a battery-operated floor maintenance machine, it may be desirable to control the down pressure of the work tool over time (and thus the work output) based on the status of the battery. In yet another example, a table or chart or equation may be referenced which relates tool work (either calculated directly with tool speed and torque measurements or motor current and voltage measurements) to state of battery charge. Such a table or chart or equation (implemented in software and/or hardware) could be used to provide different operational characteristics during a machine operational session. For example, a table may be used to relate work output to state of charge such that as the battery charge decreases, the work output would remain constant or follow some predetermined curve (increasing or decreasing over time). Such control schemes advantageously could extend the useful operating life of the battery-operated machine and/or provide more consistent work results. The controller 60 illustrated in the control system of FIG. 1 can be configured to implement such a control scheme.

Referring to FIG. 1, the controller 60 is configured to sense, via an input 61, the voltage $V_O$ provided by the power source 30. Based on the sensed voltage, the controller 60 generates a control signal $V_C$ which is provided to the voltage regulator 40. Based on the control signal $V_C$, the regulator 40 adjusts the regulated voltage output $V_R$. For example, if the regulator 40 is configured as a pulse width modulator, then variations in the control signal $V_C$ will cause the regulator 40 to vary the duty cycle of the regulated output signal $V_R$. Variations in $V_R$ cause corresponding variations in the rotational speed of the motor 16 and the rotatable driver 12, and thus affects the work output delivered to the floor 24.

Figure 2:
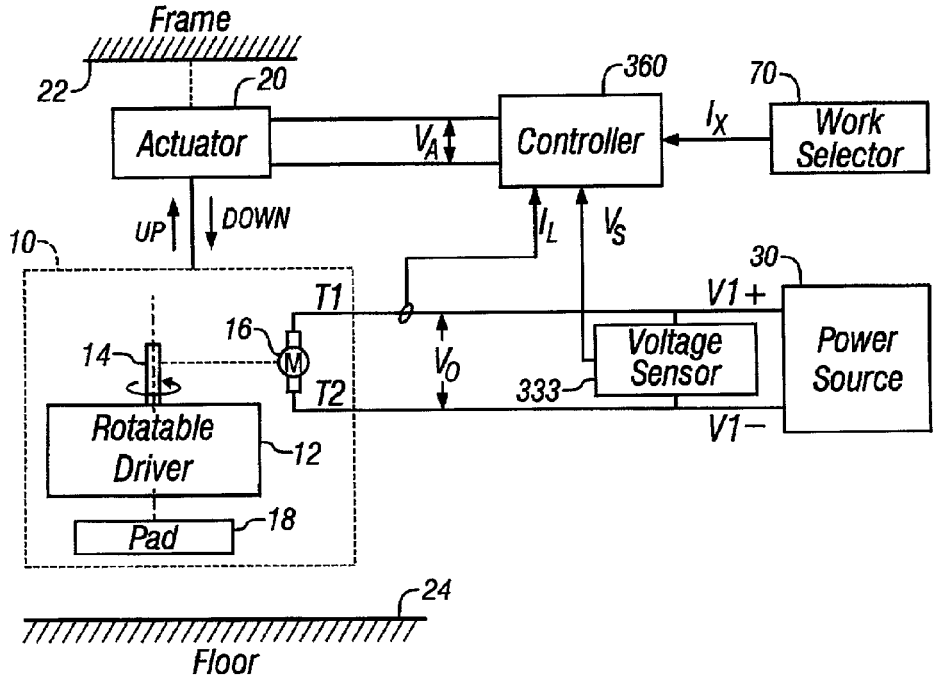
FIG. 2 is a schematic block diagram of another exemplary embodiment of a control system for a floor maintenance appliance for controlling the work output delivered to a floor surface.

FIG. 2 illustrates a schematic block diagram of another exemplary control system for controlling the work output of a floor maintenance machine. In this embodiment, the voltage $V_O$ provided to the motor 16 is not regulated. Thus, variations in both the load current $I_L$ and the motor voltage $V_O$ influence the work output provided to the floor 24. To compensate for these variations such that the work output can be controlled at a desired level, both the motor load current $I_L$ and the voltage $V_O$ provided by the power source 30 to the motor 16 are monitored.

As illustrated in FIG. 2, the current sensor 50 provides the input signal $I_S$, which is representative of the load current $I_L$, to a controller 360. Likewise, a voltage sensor 333 provides an input signal $V_S$ representative of the motor voltage $V_O$ to the controller 360. Further, the work selector 70 provides the input signal $I_X$ representative of the desired work output to the controller 360. Based on the input signals $I_S$, $V_S$, and $I_X$, the controller 360 generates the control signal $V_A$ which causes the actuator 20 to move upwardly and downwardly relative to the floor 24 as appropriate to control the work output provided to the floor 24 based on the selected level indicated by $I_X$. Accordingly, in the embodiment illustrated in FIG. 2, the controller 360 is configured to control the work output delivered to the floor 24 based on the selected work selector value $I_X$ and the product of $I_L$ and $V_O$ (i.e., the power delivered to the motor 16). In alternative embodiments, relationships between $I_L$ and $V_O$ other than their product can be used to control the work output delivered to the floor 24.

The voltage sensor 333 may be implemented in a variety of different manners, such as by a capacitive circuit configured to store and track the voltage $V_O$ provided by the power source 30, etc. The controller 360, as well as the controller 60, also may be implemented in a variety of different manners, such as by discrete analog and/or digital circuitry, integrated circuits, programmable arrays, microprocessor or micro-controller based circuitry, software, firmware, etc., or any combination of the foregoing. Specific values of Ix that may be selected will vary, dependent upon the chosen circuit configurations and specific floor maintenance machine assembly characteristics.

Similar to the controller 60, the controller 360 may be configured to vary the work output in accordance with other parameters, such as the status of the power source 30 over time. For example, the controller 360 may be configured to adjust the signal $V_A$ over time to compensate for decay of the voltage provided by the power source 30 over time. Thus, the work output delivered to the floor can be controlled based on both the selected work output indicated by $I_X$ as well as the signal $V_S$.

In practice, it has been found that stability and reliability of the control schemes illustrated in FIGS. 1 and 2 outweigh the benefits of a control scheme that can quickly respond to variations that cause changes in work output. For example, as the floor maintenance machine is moved over the floor 24, floor surface variations can cause temporary variations in the load current $I_L$. Because the assembly 10 is configured to have a certain amount of resiliency to compensate for such floor surface variations and because such variations typically are short-lived, the controller 60 or 360 need not be configured to compensate for such variations, thus simplifying the design. Accordingly, in an exemplary embodiments illustrated in FIGS. 1 and 2, the controllers 60 and 360 are configured to respond to a variation in the monitored load current IL only if the variation has persisted longer than a given amount of time.

Another advantage of a controller configuration that does not have a particularly quick response time is that movement of the assembly 10 relative to the floor 24 typically will occur infrequently. Thus, once the actuator 20 has moved the assembly 10 to the desired position relative to the floor 24, the signal $V_A$ applied by the controller 60/360 to the actuator 20 can be removed. Such discontinuous application of the signal $V_A$ to the actuator 20 can prevent overheating and damage to the actuator 20, and, consequently, will prolong the useful life of the floor maintenance machine.

Further, it should be understood that although the foregoing exemplary embodiments contemplate the ability to select a desired work output, in alternative embodiments, the control system can be configured such that the work output is not a user-selectable parameter but rather is determined by the controller based on other parameters, such as type of work tool and the task to be performed, a sensed characteristic of the floor surface, etc.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A control system for controlling work output delivered to a floor surface by a rotatable work tool, the control system comprising a power source;

a motor assembly coupled to the power source and the rotatable work tool, the motor assembly configured to rotatably drive the rotatable work tool;

a voltage regulator circuit coupled between the power source and the motor assembly, the voltage regulator circuit configured to provide a selected output voltage to the motor assembly;

an electric actuator assembly coupled to the rotatable work tool and configured to adjust contact of the rotatable work tool with the floor surface;

a current sensor in communication with the motor assembly, the current sensor configured to monitor a motor current to the motor assembly, said current sensor providing a variable current signal; and a controller circuit in communication with the current sensor so as to receive the variable current signal, the voltage regulator circuit, and the actuator assembly, the controller circuit configured to supply an actuator voltage to the actuator assembly causing the actuator assembly to raise or lower the rotatable work tool relative to the floor surface based on the variable current signal and a desired work output, such that the work output delivered to the floor surface is controlled.

2. The control system as recited in claim 1, wherein the controller circuit is in communication with the voltage regulator circuit and wherein the voltage regulator circuit regulates the output voltage from the power source based on a control signal received from the controller circuit.

3. The control system as recited in claim 2, wherein the controller circuit is configured to monitor the output voltage provided byte power source and to generate the control signal based on the monitored output voltage.

4. The control system as recited in claim 3, wherein the controller circuit is configured to cause the actuator assembly to adjust contact of the rotatable work tool with the floor surface based on the monitored output voltage.

5. The control system as recited in claim 1, wherein the power source comprises a rechargeable power source.

6. The control system as recited in claim 1, comprising a work selector circuit in communication with the controller circuit, wherein the work selector circuit is configured to indicate a selected work output to be delivered to the work surface, and the controller circuit is configured to cause the actuator assembly to adjust contact of the rotatable work tool with the floor surface based on the selected work output.

7. The control system as recited in claim 6, wherein the selected work output is selectable by a user.

8. A control system to control work output delivered to a floor surface by a rotatable work tool, the control system comprising:

a power source;

a motor assembly coupled to the power source and the rotatable work tool, the motor assembly configured to rotatably drive the rotatable work tool;

an electric actuator assembly coupled to the rotatable work tool and configured to adjust contact of the rotatable work tool with the floor surface;

a current sensor in communication with the motor assembly, the current sensor configured to monitor a motor current to the motor assembly, said current sensor providing a variable current signal;

a voltage monitor circuit in communication with the power source, the voltage monitor circuit configured to monitor an output voltage provided by the power source, said output voltage being controllable via a voltage regulator; and a controller circuit in communication with the current sensor so as to receive the variable current signal, the voltage monitor circuit, and the actuator assembly, the controller circuit configured to provide an actuator voltage to the actuator assembly causing the actuator assembly to raise or lower the rotatable work tool to adjust contact of the rotatable work tool with the floor surface based on the variable current signal and the monitored output voltage to control a work output delivered to the floor surface.

9. The control system as recited in claim 8, wherein the controller circuit is configured to cause the actuator assembly to adjust contact of the rotatable work tool based on the combination of the monitored load current and the monitored output voltage.

10. The control system as recited in claim 8, comprising a work selector circuit in communication with the controller circuit, wherein the work selector circuit is configured to indicate a selected work output to be delivered to the work surface, and the controller circuit is configured to cause the actuator assembly to adjust contact of the rotatable work tool based on the selected work output.

11. The control system as recited in claim 10, wherein the selected work output is selected by a user.

12. The control system as recited in claim 8, wherein the power source comprises a rechargeable power source.

13. A method of controlling work output delivered to a floor surface by a work tool and a motor assembly to drive the work tool, the method comprising:

regulating a motor voltage provided by a power source with a direct current voltage regulator controlled by a controller circuit;

providing the regulated direct current motor voltage to the motor assembly;

monitoring a motor current drawn by the motor assembly;

providing an actuator assembly; and applying a voltage to the actuator assembly so that the actuator assembly lifts or lowers the work tool relative to the floor surface based on the monitored motor current, thereby controlling the work output delivered to the floor surface.

14. The method as recited in claim 13, comprising:

selecting a desired work output; and adjusting contact of the work tool with the floor surface based on the selected desired work output.

15. The method as recited in claim 13, comprising:

monitoring the motor voltage provided by the power source; and adjusting the regulated motor voltage based on the monitored motor voltage.

16. The method as recited in claim 14, comprising:

monitoring the motor voltage provided by the power source; and applying the voltage to the actuator assembly so as to adjust contact of the work tool with the floor surface based on the selected desired work output.

* * * * *